United States Patent [19]

Delligatti

[11] 4,068,578

[45] Jan. 17, 1978

[54] SEQUENCE NUMBERING CODE MARKING DEVICE

[76] Inventor: Patrick Delligatti, c/o Dalemark Industries Inc., 950 Airport Road, Lakewood, N.J. 08701

[21] Appl. No.: 712,217

[22] Filed: Aug. 6, 1976

[51] Int. Cl.[2] ..... B41F 17/26

[52] U.S. Cl. ..... 101/35; 101/72; 101/85

[58] Field of Search ..... 101/35, 85, 76, 72–75, 101/77

[56] References Cited

U.S. PATENT DOCUMENTS

| | | | |
|---|---|---|---|
| 941,110 | 11/1909 | Sykes | 101/75 |
| 1,274,831 | 8/1918 | Woodward | 101/76 X |
| 1,569,085 | 1/1926 | Heyne, jr. | 101/77 |
| 3,122,993 | 3/1964 | McKay | 101/35 |
| 3,624,730 | 11/1971 | Gottscho | 101/35 |
| 3,702,000 | 10/1972 | Delligatti | 101/35 X |
| 3,808,970 | 5/1974 | Delligatti | 101/35 |

*Primary Examiner*—Clifford D. Crowder

*Attorney, Agent, or Firm*—Sixbey, Bradford & Leedom

[57] ABSTRACT

A sequence numbering code marking device includes a rotary drum housing, a stroke actuated sequential numbering printing head operated by a pivotally mounted trip lever which is eccentrically mounted on a center post to trip the counter with each revolution of the drum. Means are provided to positively cause rotation of the drum by each passing article and an improved null return mechanism is provided to cause the drum to stop its rotation at a preselected position after each rotation.

7 Claims, 3 Drawing Figures

SEQUENCE NUMBERING CODE MARKING DEVICE

PRIOR ART

Quite often in various and sundry manufacturing or packaging operations, it is desirable or necessary to mark successive objects with consecutive indicia such as numbers or letters as when applying successive serial numbers or the like. One method of applying successive numbers or letters or even combinations of both to successive articles or successive packages containing articles is by printing the indicia thereon as the objects move along a manufacturing or packaging line on some form of conveyor. Such printing machines include a printing wheel which contains a consecutive numbering device and which is driven or rotated by contact with the article itself. The printing wheel is rotated through a single revolution as it is contacted by each object and means are provided whereby each revolution operates a numbering device having type wheels which can print consecutive numbers one at a time on the successive objects.

One consecutive numbering device previously known includes a support post upon which is mounted a cantilevered support. The support, in turn, carries the printing device and an inking wheel against which the type faces come in contact with each revolution of the printing wheel. Also provided is a so-called "null positioning assembly" whereby the printing wheel is returned to a pre-set position after each rotation.

The device referred to above is extremely complex, being assembled from a myriad of individual parts which contribute both to the expense of the device and to the risk of unreliable operation and breakdown due to wear and breakage.

When it is considered that any malfunction of the sequential numbering device could require the shut down of an entire production or packaging line while repairs are made or another unit is substituted for the ailing device, it becomes apparent that ruggedness is a factor of no mean consideration when such devices are incorporated in a manufacturing or packaging operation.

One way of assuring ruggedness and reliable operation of any device is to reduce the number of parts and reduce wear between moving parts, particularly sliding wear so often associated between cams and cam followers and the like.

THE PRESENT INVENTION

Recognizing the need for rugged, reliable, wear free sequential numbering and/or lettering devices, the general object of the present invention is to affect that end result.

Another object of the invention is to provide a sequential printing device that is extremely simple and fabricated from a minimal number of parts.

Still a further object is to provide a sequential printing device that is virtually devoid of wear.

Additionally, it is another object of the invention to reduce the sliding friction between moving parts in a sequential numbering or lettering device to the absolute minimum.

These and other objects not specifically alluded to but inherent therein and readily apparent to those skilled in the art may be accomplished by providing an open ended cylindrical shell, having an aperture therein through which the type faces project, top and bottom covers closing the shell, each being mounted on a center post by anti-friction bearings, the bottom cover having affixed thereto a second vertical post surmounted by a roller, a spring biased cam collar surrounding said post and biased against said collar, a vertically disposed yoke mounted also on said bottom collar and carrying a commercially available sequential printing assembly, a trip arm eccentrically mounted on the top of the post, said trip arm having a depending tongue in engagement with the printer rachet whereby upon each rotation of said wheel at least one printing wheel is advanced one number and said wheel returns to a pre-selected null position under the bias of said spring and cam assembly.

Having described my invention broadly, attention is now invited to the drawings forming a part of the disclosure and to which reference will be made as this detailed description now proceeds and wherein:

FIG. 2 is a top plan view partly in section of the printing drum only, while

Figure 1:
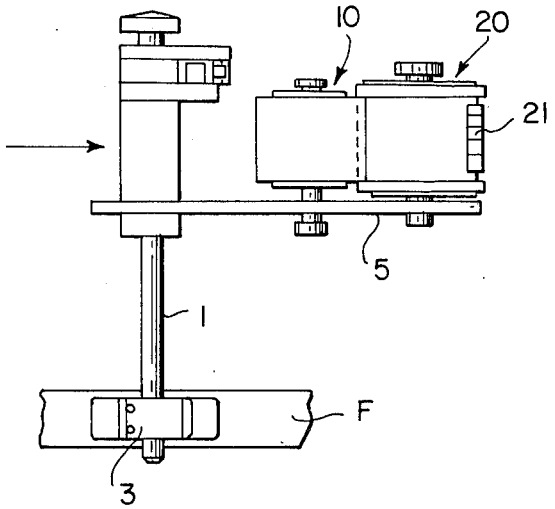
FIG. 1 is a side elevational view of a complete printing device as it would be mounted on a packaging or manufacturing device.

Turning attention, first, to FIG. 1, it may be seen that the marking device includes a mounting post 1 and a bracket assembly 3 whereby the post may be attached to the frame F of a conveyor or whatever type of machine with which it will be used. Pivotally connected to the support post is pivot arm 5 which serves as the frame for carrying inking wheel 10 and the printing wheel 20. The pivot arm is biased about the post, as is conventional, so that the pivot arm tends to swing toward the articles passing along the production or packaging line. The inking wheel and printing wheel arrangement is conventional also, it being obvious that the function of the inking wheel 10 is to apply ink to the type wheels 21 carried by the printing wheel so that as the printing wheel is rotated it will print the code or whatever on the articles.

Figure 3:
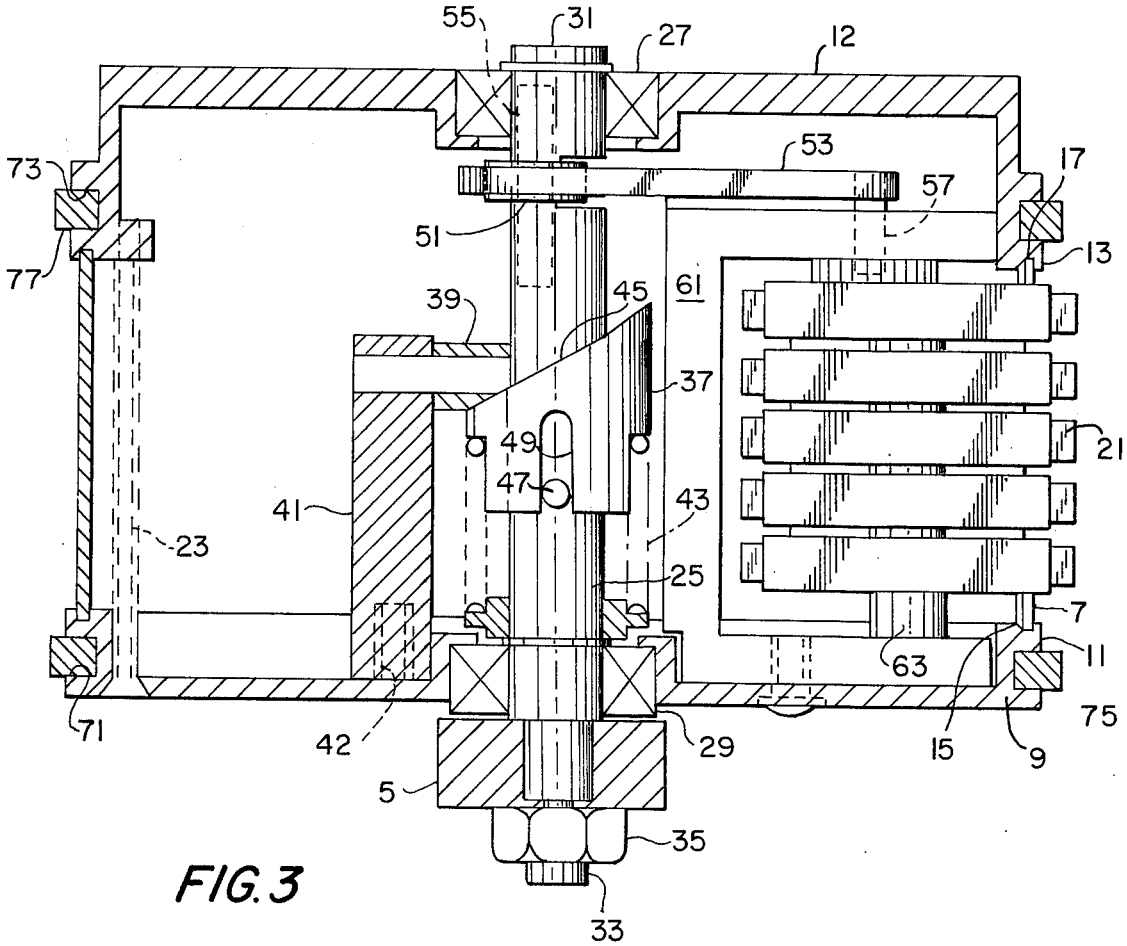
FIG. 3 is a sectional view taken along the line 3—3 of FIG. 2.
Figure 2:
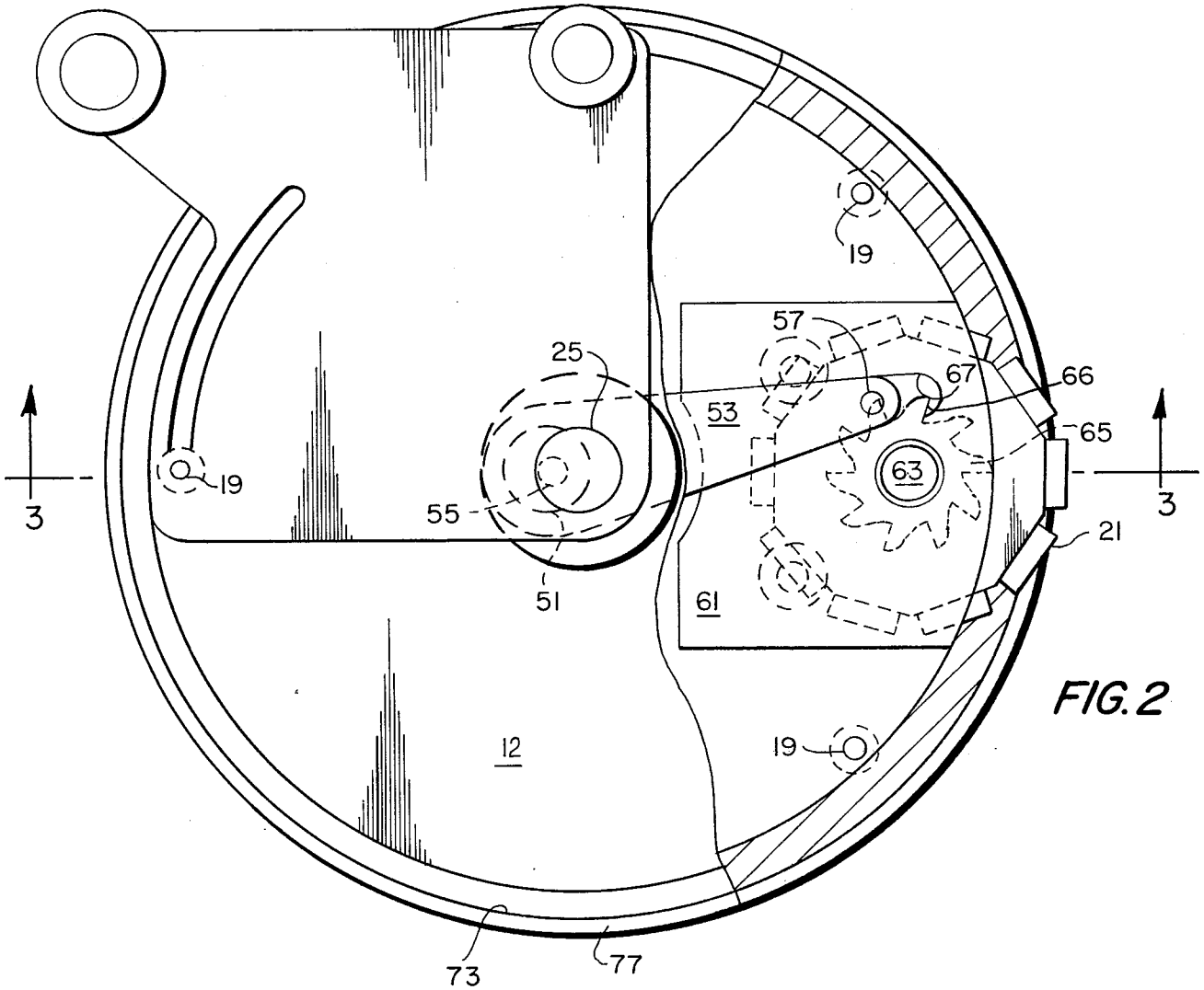

The details of the printing wheel are shown in FIGS. 2 and 3. As illustrated, the wheel is comprised of a hollow cylindrical drum 7 having its upper and lower open ends closed by a bottom cover 9 and a top cover 12. Each of the covers is provided with a relatively thick peripheral lip 11 and 13, respectively and each lip is provided with an annular groove 15 and 17 which fit over the ends of drum 7. A series of three bolts 23 spaced 120° apart pass through the lower cover and engage threaded bosses 19 provided on upper cover 12 to hold the drum and covers assembled properly yet permit access to the interior of the drum when it is necessary to gain access thereto.

Passing through the two covers 9 and 12 is a spindle 25 on which the assembly rotates on anti-friction bearings 27 and 29. The top of the spindle is provided with a head 31 which bears against the upper bearing 27 and its lower threaded end 33 passes through support 5 to receive retaining nut 35. Obviously, though not shown, suitable washers may be imposed between these various parts.

In order to return the printing wheel to a null position, the spindle 25 is encircled by a vertically movable cam collar 37 which bears against a roller follower 39 rotatively mounted on a vertical post 41 affixed to the bottom cover 9 by machine screw 42. Disposed beneath the cam collar 37 is a coil spring 43 also surrounding spindle 25 this spring being under partial compression to bias the upper cam surface 45 against follower 39. Spindle 25 is further provided with a horizontal transverse pin 47 which engages a slot 49 provided in the cam collar 37. Thus, as the printing wheel is rotated, the follower 39 causes the cam collar 37 to move downwardly against the bias of spring 43, the collar being held against rotation by pin 47 and slot 49. The shape of cam surface 45 is such that, when the wheel is rotated from its null position, it is biased back to that position either in one direction or the other depending on whether or not the wheel 20 has been rotated more or less than 180°. Reference may be had to U.S. Pat. No. 3,808,970 for further amplification of this arrangement.

As clearly shown in FIG. 3 the spindle 25 is so formed adjacent its top end and beneath the assembled position of cover 12 as to define an axially offset crank throw journal 51 to which is rotatively journaled a counter trip lever 53. The journal 51 is formed by joining two aligned sections of the spindle above and below the journal by a double ended, threaded connector 55, however, it will be appreciated that there are a variety of ways the trip lever can be connected to the spindle other than that specifically disclosed.

The counter trip lever is provided at its free, cantilevered end with a downwardly extending rachet pin 57 which projects into the print wheel assembly. This latter assembly is strictly a conventional, off-the-shelf rachet operated sequence numbering device such as manufactured by Atlantic Numbering Co. and known as a stroke actuated rachet numberer. Thus, while it is not necessary to describe the mechanism in detail, it must be stated that it is comprised of a yoke like frame 61 affixed, by a suitable fastener, immobile on the top surface of cover 9. Rotatively mounted in the yoke adjacent the end of its parallel arms are a series of type wheels 21 on a vertical shaft 63. Suitable rachet devices are interposed between each type wheel whereby, as each wheel completes one revolution, it causes the rachet mechanism of the next adjacent wheel to advance by partial revolution to bring the next indicia on that wheel into printing position in alignment with the indicia represented by the type faces on the remainder of the type wheels. In this case the upper type wheel is operated by the rachet 65, shown schematically, having the same number of operating lands 66 as there are indicia spaced around the periphery of the printing wheel and defining the type faces. The rachet pin 57 engages the rachet teeth through a slot 67 provided in the upper arm of yoke 61 as is clearly shown in FIG. 2.

Digressing briefly back to the top and bottom covers 9 and 12, it will be noted that each is provided with an outwardly opening peripheral groove 71, 73 respectively. Seated within these grooves are annular rings 75, 77 fabricated of rubber or some similar material. The purpose of rings 75, 77 will subsequently become apparent.

OPERATION

Referring to FIG. 1, let it be assumed that the sequential numbering device is affixed to a conveyor frame F and that articles such as boxes or crates are being conveyed along the conveyor in the direction indicated by the arrow. The sequential marking device is mounted in such a position that the printing wheel is in the path of the moving boxes to a slight degree so that as each box passes, it will be contacted by the rings 75, 77. As the article continues its movement the frictional engagement between itself and the rings will cause the wheel to rotate about spindle 25. This causes the cam collar to move downwardly against the bias of spring 43. At the same time, due to its eccentric connection with spindle 25, the trip lever will also pivot about the spindle and as the printing wheel 20 approached a point of about 180° rotation the rachet pin 57 will have ridden over one rachet tooth of rachet 65 and thus is ready to operate the rachet when the printing wheel returns to its null position under the biasing influence of the spring biased cam 37 after the article has passed. During its rotation the type wheels will first contact ink roller 10 and the type faces of type wheels 21 will be inked. Then they contact the article to imprint the indices thereon. The article having passed, the printing wheel returns to null position and in so doing the rachet pin 57 moves the rachet 65 to bring the next type face in alignment with the remainder of the printing wheels so as to imprint the next sequence of the indicia on the next passing article.

From the above description it is believed readily apparent that a very straight-forward, simple, rugged sequential printing device is disclosed. Further, the number of parts is vastly reduced as compared to the prior art thus reducing the likelihood of failure due to wear and tear.

From the foregoing description, changes in and modifications thereof will occur to those skilled in the art, all of which fall within the spirit and scope of the claims wherein

What is claimed is:

1. Apparatus for forming successive code marks on successive mark receiving surfaces such that the marks are positioned a predetermined distance from the leading edge of each successive mark receiving surface as the mark receiving surfaces move along a predetermined path in spaced apart relationship, said apparatus comprising a. a support spindle;

b. a housing rotatably supported on said support spindle adjacent the predetermined path;

c. surface engaging means mounted on said housing for successively engaging each mark receiving surface as the surface moves along the path and for rotating said housing when in engagement with each mark receiving surface;

d. biasing means for continuously angularly biasing said rotatable housing toward a null position having a predetermined angular relationship with said support spindle to cause return of said housing to said null position between disengagement of said surface engaging means with one mark receiving surface and engagement of said surface engaging means with the next succeeding mark receiving surface;

e. advanceable code forming means mounted to rotate with said housing and positioned to form a successive code mark on each successive mark receiving surface when said surface engaging means is engaged therewith;

f. advance means for causing said code forming means to advance to form the next successive code mark upon rotation of said housing in excess of 180° beyond said predetermined null position, said advance means including 1. a cam surface eccentrically mounted with respect to the longitudinal axis of said support spindle, 2. an actuating lever means extending between said cam surface and said advanceable code forming means and movable between a fully retracted position and a fully advanced position, said cam being positioned eccentrically to move said actuating lever means into said fully retracted position when said housing is in the null position and to move said lever means to said fully advanced position when said housing is rotated to a position 180° from said null position, and 3. ratchet means for preventing said actuating lever from initiating advance of said advanceable code forming means when said activating lever means moves from its fully retracted position to its fully advanced position and for initiating and completing one advance of said advanceable code forming means each time said actuating lever means moves back from said fully advanced position to said fully retracted position.

2. Apparatus as defined in claim 1 wherein said advanceable code forming means includes at least one code wheel carrying a plurality of indicia on the periphery, said code wheel being rotatable to successively place an indicium in a mark forming position and wherein said ratchet means including a ratchet wheel is operatively connected with said code wheel to rotate said code wheel sufficiently to move a successive indicium into the mark forming position upon movement of said actuating lever means from said fully extended to said fully retracted position.

3. Apparatus as defined in claim 2 wherein said ratchet wheel includes a plurality of radially extending teeth, equal in number to the number of said indicia on said indicia wheel, said actuating lever means including a lever having one end portion for engaging said ratchet wheel and another end portion for engaging said cam surface, each tooth on said ratchet being shaped to cause said one end portion to ride over said tooth as said actuating lever means is moved from said fully retracted position to said fully advanced position and to positively engage said ratchet wheel only when said actuating lever means reaches said fully advanced position.

4. Apparatus as defined in claim 3 wherein said one end portion of said actuating lever includes a pin extending perpendicularly with regard to the plane of movement of said lever, said advance means further including a guide means containing a slot through which said pin projects for guiding said pin during movement of said lever between said fully retracted and said fully extended positions, said slot being enlarged at one end to permit said pin to pass over a ratchet tooth when said lever is advancing toward said fully extended position and to permit said pin to positively engage the same ratchet tooth when said lever is retracting from said fully extended position.

5. Apparatus as defined in claim 1 further including a pivot post and a cantilevered support pivotally mounted on said pivot post, said support spindle being mounted on said cantilevered support, wherein said housing includes an aperture in the periphery thereof, said advanceable code forming means includes a type wheel assembly including a plurality of ratchet operated type wheels projecting outwardly through said aperture, each said type wheel having plural type indicia thereon, said support spindle including an offset crank journal, said actuating lever means including a lever rotatably connected to said journal at one end and including a ratchet pin at the other end for engaging said ratchet means.

6. Apparatus as defined in claim 1 wherein said biasing means includes a cam collar slidable on said support spindle axially thereof and having a cam surface on one face thereof and a stationary roller means carried by said housing in contact with said cam surface whereby said roller moves said collar axially on said support spindle in one direction and movement of said collar in the other direction rotates said drum via said roller.

7. Apparatus as defined in claim 6 including spring means surrounding said support spindle and biasing said collar in one direction.

* * * * *